US008129640B2

(12) United States Patent
Liao

(10) Patent No.: US 8,129,640 B2
(45) Date of Patent: Mar. 6, 2012

(54) ILLUMINATING PUSH BUTTON SWITCH HAVING A MISTAKE PROOF DESIGN FOR INSTALLING A LED INTO SAID SWITCH

(76) Inventor: Hong-Ming Liao, Luchou (TW)

( * ) Notice: Subject to any disclaimer, the term of this patent is extended or adjusted under 35 U.S.C. 154(b) by 223 days.

(21) Appl. No.: 12/692,657

(22) Filed: Jan. 25, 2010

(65) Prior Publication Data

US 2011/0180377 A1 Jul. 28, 2011

(51) Int. Cl.
*H01H 9/00* (2006.01)

(52) U.S. Cl. ..... 200/314

(58) Field of Classification Search ..... 200/310–314, 200/317

See application file for complete search history.

(56) References Cited

U.S. PATENT DOCUMENTS

| | | | | |
|---|---|---|---|---|
| 4,311,990 | A * | 1/1982 | Burke | 200/317 |
| 4,496,813 | A * | 1/1985 | Fukushima | 200/314 |
| 6,310,308 | B1 * | 10/2001 | Watson et al. | 200/314 |
| 6,417,469 | B1 * | 7/2002 | Tamura | 200/314 |
| 6,770,829 | B1 * | 8/2004 | Hart | 200/314 |
| 6,984,797 | B2 * | 1/2006 | Morita et al. | 200/314 |
| 7,804,037 | B2 * | 9/2010 | Cove | 200/314 |

FOREIGN PATENT DOCUMENTS

DE 10044077 A 4/2002

* cited by examiner

*Primary Examiner* — Briggitte R Hammond

(57) ABSTRACT

An illuminating push button switch having a mistake-proof design to avoid improper installation of a light emitting diode (LED) consists essentially of a body portion (2), a cap portion (1) attached above said body portion (2), and a LED (6) inserted into the body portion (2) from the bottom. Said push button switch is characterized in that said body portion (2) incorporates a light cap (22), and a slot (23) for receiving the LED (6). A frame portion (30) is reciprocating along the light cap (22) for activating/deactivating the switch. Said mistake-proof design is provided at an inner wall of the slot (23).

10 Claims, 9 Drawing Sheets

Prior Art

ILLUMINATING PUSH BUTTON SWITCH HAVING A MISTAKE PROOF DESIGN FOR INSTALLING A LED INTO SAID SWITCH

FIELD OF THE INVENTION

The present invention relates to a structure of an illuminating push button switch and its mistake-proof design and a method for installing a light emitting diode (LED) conveniently into said switch.

BACKGROUND OF THE INVENTION

An illuminating push button switch is a type of switch which has been widely used in products around our life. It simply indicates whether a device is switched on/off or which floor the elevator will stop by the illumination of a light source incorporated within the switch. A conventional illuminating push button switch as shown in the FIG. 9 discloses a push button arrangement on circuit board e.g. for production mixer in television studios, having light source encompassed by a push button with transparent top. Said switch consists essentially of a base (7) for accommodating a light source (70) and a cap portion (8). A light guiding element (71) is provided at the center of the base (7) to project the light upwardly and a transparent plate (72) is disposed onto said light guiding element (71) for reflecting the light. Two metal elements (73, 74) are provided about the periphery of the light guiding element (71). Said cap portion (8) comprises of a transparent cover (82) and a frame (81). A transparent film (83), printed with figures or characters, is provided at the bottom of the cover (82). The illumination is provided by connecting electrically the light source (70) (e.g. LED) to a printed circuit board (PCB) (9). For further information regarding the structure of the traditional illuminating push button switch, please refer to the cited document DE 10044077A, entitled "Die folgenden Angaben sind den von Anmelder eingereichten Unterlagen entnommen".

Said push button switch as disclosed in FIG. 9 or cited reference owns following drawbacks:

1. The assembling methods initiates by connecting the light source (70) to the PCB (9). Afterward, the push button switch assembly is further engaged with the PCB (9) and receives the light source (70) within. The two steps assembling method complicates the installation as for the maintenance either. Further, the base of the switch has a complex structure; the installations and assembling of the light guiding element (71), said metal elements (73, 74), springs and frame (81) require specific tool and special training, increasing the manufacture cost and difficulty of the maintenance. Therefore, to provide a push button switch with simple structure for simplifying the assembling or repairing method has become the primary objective of the present invention.
2. As disclosed previously, said base (7) is made of transparent material, and the light guiding element (71) is against the light source. Thus, when the light source (70) is fastened onto the PCB (9) by welding or gluing, the solder or glue may be transferred to the light guiding element (71) and lower the effect thereof. Thus, to prevent the illumination affect by the fastening means has become another objective of the present invention.
3. The light source (70) is further engaged with said light guiding element (71) by gluing. Besides than reducing lighting effect as disclosed previously, it troubles the replacement of the light source (70). Thus, finding an easy and simple way to install the light source without damaging both light source and switch structure has become another objective of the present invention.
4. Since the light is emitting upwardly, the plate (72) is provided to diffuse partial of light emission toward the sides. However, it reduces the light which can be seen from the cap (8). Therefore, to ensure that light is bright and visible from the cap (8) is also an objective for the present invention.

SUMMARY OF THE INVENTION

To achieve foregoing objectives, an illuminating push button switch is realized by having a simpler structure and a mistake-proof design to simplify the installation of a light emitting diode (LED) into said switch and prevent the misconnection.

Said push button switch comprises of a body portion (2) and a cap portion (1). A light emitting diode (LED) (6) is inserted for lighting said cap portion (1). the push button switch is characterized in that said body portion (2) consists essentially of a base (20) incorporated a concave portion (21), a frame portion (30) disposed in said base (20), a hollow cover (50) where the hollow portion allows the frame portion passes through, at least two vertical springs (40) and/or two horizontal springs (41) provided in the base (20) for supporting the frame portion (30), and at least two connector pins (27*a*, 27*b*) provided on a bottom side of the base (20); said cap portion (1) is attached to a top of the frame portion (30). A light cap (22) is disposed inside said concave portion (21) and said slot (23) is provided on a bottom side for receiving at least one Epoxy case (62) of a LED (6). Said frame portion (30) has an axial passage (34) to allow the light cap (22) passing through from a bottom side thereof, and said frame portion (30) can move reciprocally along the light cap (22).

Further, two connector pins (27*a*, 27*b*) have the U shape metallic plates (271, 272) at its upper portion respectively. Both plates (271, 272) are symmetrical and provided along an inner wall of said concave portion (21), and encircle about a periphery of said frame portion (30); a top of said plates (271, 272) butts a projected edge (53) disposed at an inner side of the cover (50). A first leaf-spring (273) is extended from an end of the plate (271) and a second leaf-spring (274) is extended from an end of the plate (272). Said leaf-springs (273, 274) are pushed outwardly when said frame portion (30) is pressed down and contact with an end (272*a*) of the plate (272) and an end (271*a*) of the plate (271) respectively to form a closed circuit.

Said passage (34) comprises of a straight portion (341) for accommodating the light cap (22) at one end, and a tapered portion (342) connected to another end thereof to diffuse the light emission.

Furthermore, two wedge-shaped protrusions (281, 282) are provided on two opposite sides of an outer wall of the base (20) to engage with two slots (51, 52) provided on two opposite sides of said cover (50).

The cap portion (1) of said switch comprises of an inner cap (11) having at least two slots (111), and an outer cap (12) covered said inner cap (11). Said slots (111) correspond to two projections (35) provided on an upper portion of an outer wall of the frame portion (30).

Moreover, an end of each said compression spring (40) is engaged to a first column (251), provided at the concave portion (21) and another end is inserted into a positioning hole (31), provided at a bottom of the frame portion (30).

Each of said horizontal springs (41) is provided between two ends of a C-shaped holder (33), forming an arc shape; said holder (33) is provided at a groove (32) disposed at the bottom of said frame portion (30). A second column (252) is provided at the concave portion (21) for butting the extension spring (41).

As to ensure that the replacement of LED (6) requires no special tool or training, a mistake-proof design is provided thereby setting a pair of locking projections (231), at two opposite ends and different height of an inner wall of the slot (23), and a pair of jointing projections (621), corresponding to said locking projections (231), at an outer wall of the Epoxy case (62). Since both locking projections (231) are provided at different height, thus the LED (6) can only be installed properly into the slot (23) by inserting when the jointing projections (621) match the correct locking projections (231).

Comparison with the Prior Art

1. Unlike the traditional illuminating push button switch, which the LED couples with the switch by gluing, the LED engages the illuminating switch button by simply inserting into a slot within the switch. Thus the installing and maintenance time is reduced gradually.
2. The light source and the body of the conventional illuminating push button switch are fastened separately onto the PCB. The present invention, however, secures the light source with the slot, thus both elements can be fastened onto the PCB simultaneously. Besides, the light source is kept within the slot which can prevent its illuminating surface being damaged during the assembling process.
3. Detachable LED. The Epoxy case of the LED is not glued with the push button and the connector pins are not connected with connector pins of the button, thus the LED is detachable; LED with different colors or Multi-Color LED can be custom installed by the preference of the user. The detachable LED also facilitates the maintenance and replacement of LED in case of any mal function.
4. By replacing the transparent plate which diffuses the emission with a light passage, the tapered portion of the passage transmit the light in a radiating fashion, to illuminating the cap with bright and even lighting effect.
5. The mistake-proof design can prevent the LED being installed and connected erroneously. It also simplifies the assembling procedure as can be done by any person with or without relating knowledge.
6. By changing the structure of the slot, the push button is able to receive multiples LEDs without complicating the assembling procedure.

DETAIL DESCRIPTION OF PREFERRED EMBODIMENTS

Figure 1:
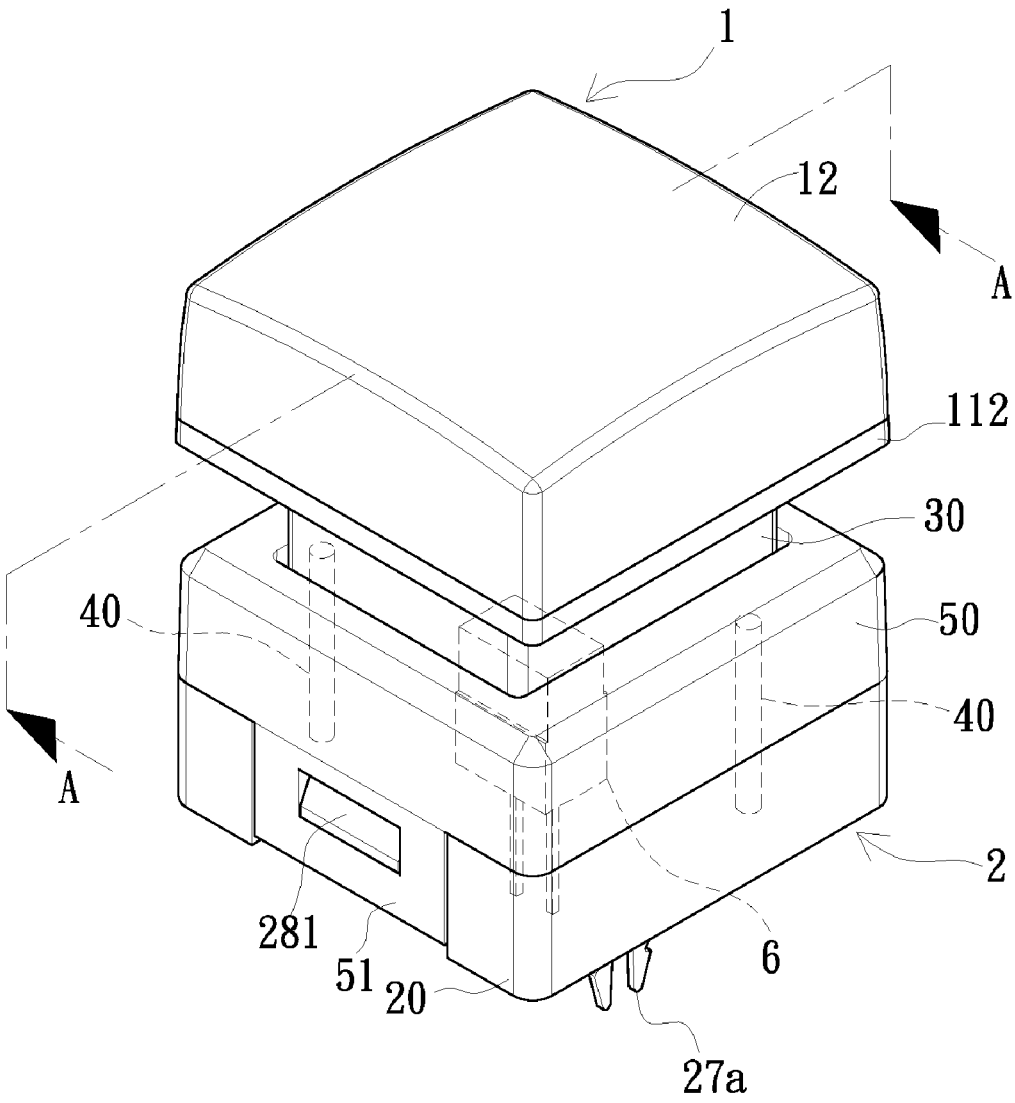
FIG. 1 is a schematic view of the present invention.
Figure 2:
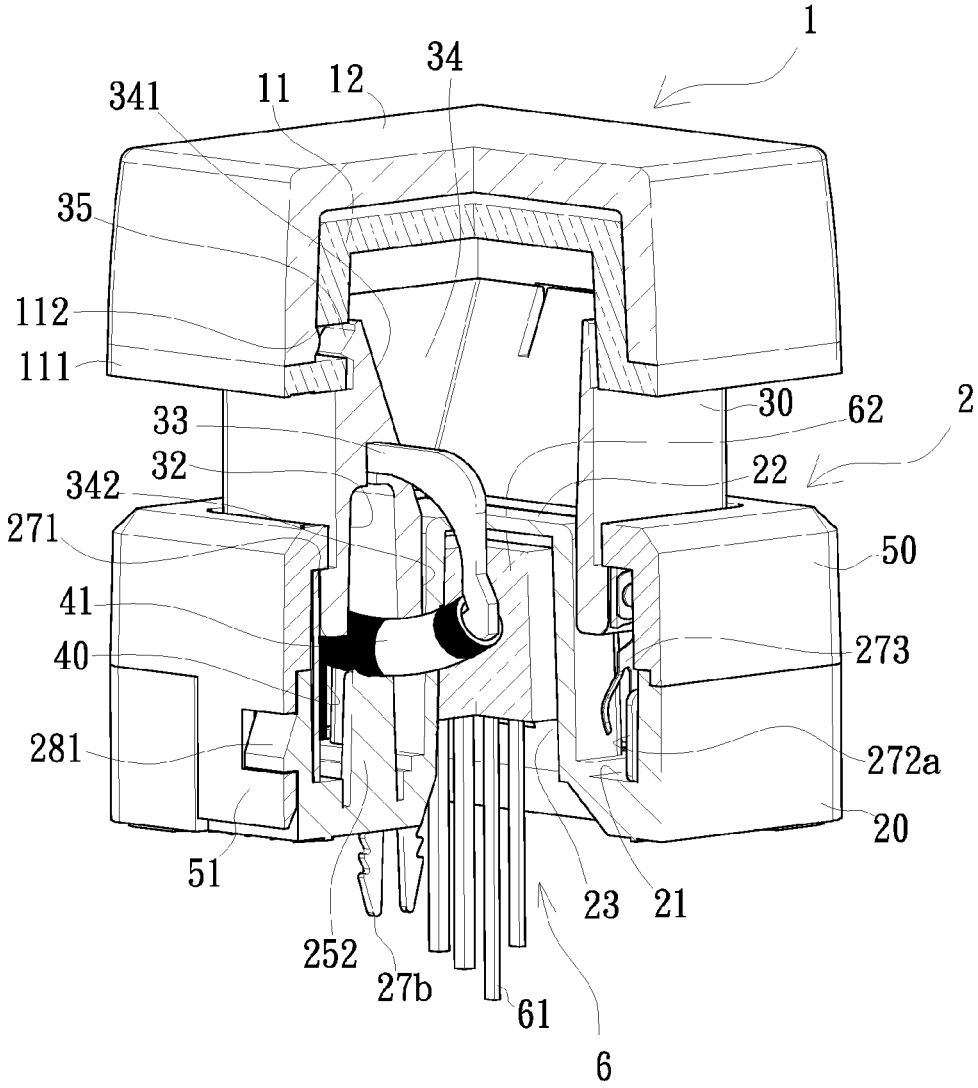
FIG. 2 is a cut-away view of the present invention.

Referring to FIGS. 1 and 2, an illuminating push button switch consists essentially of a body portion (2) and a cap portion (1). The illumination is provided by a light emitting diode (LED) (6) within a slot (23) of the body portion (2). The LED (6) can be easily installed in the switch by inserting its Epoxy case (62) into the corresponding slot (23).

Figure 3:
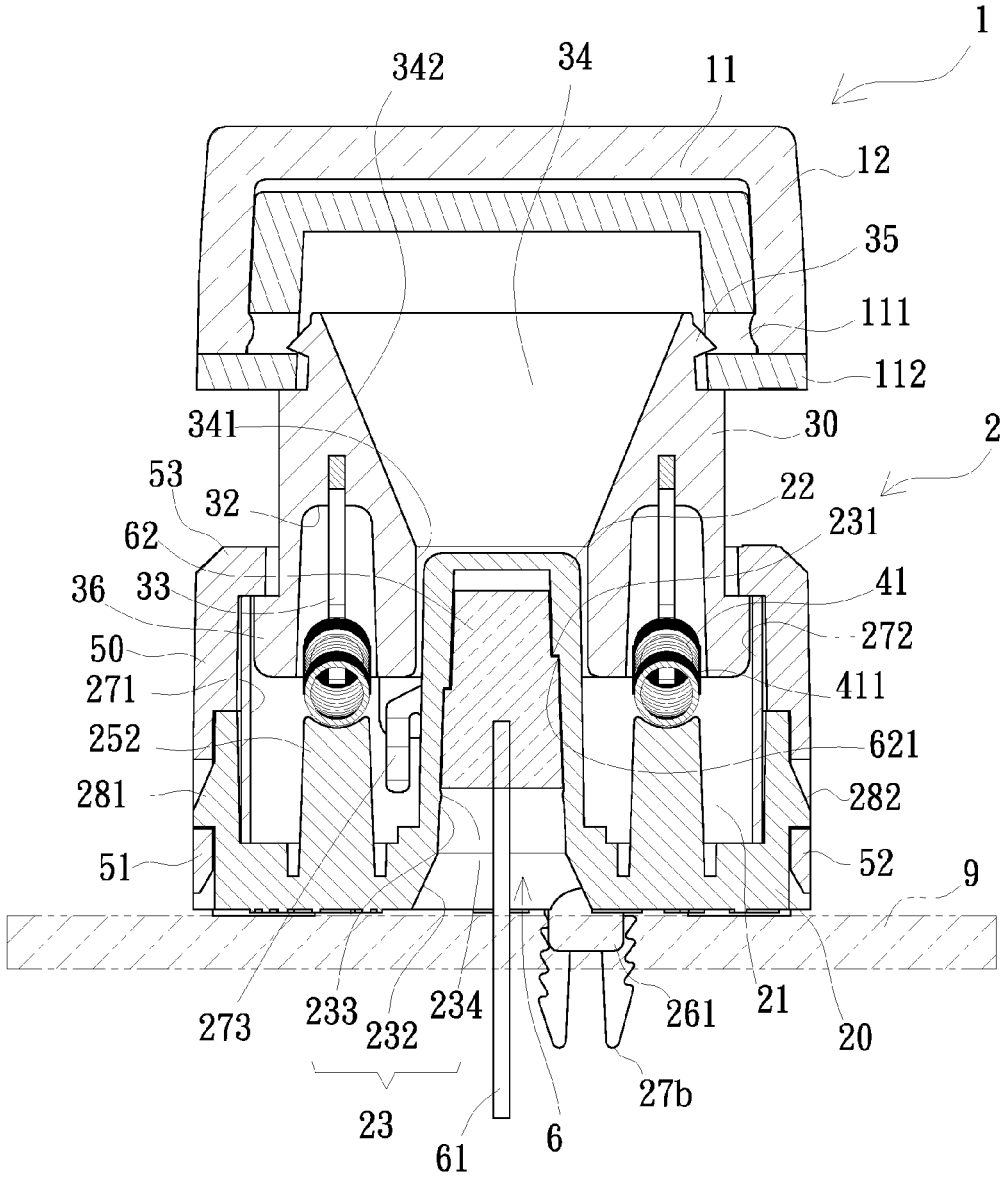
FIG. 3 is a cross-sectional view of the FIG. 1 along the line A-A.
Figure 5:
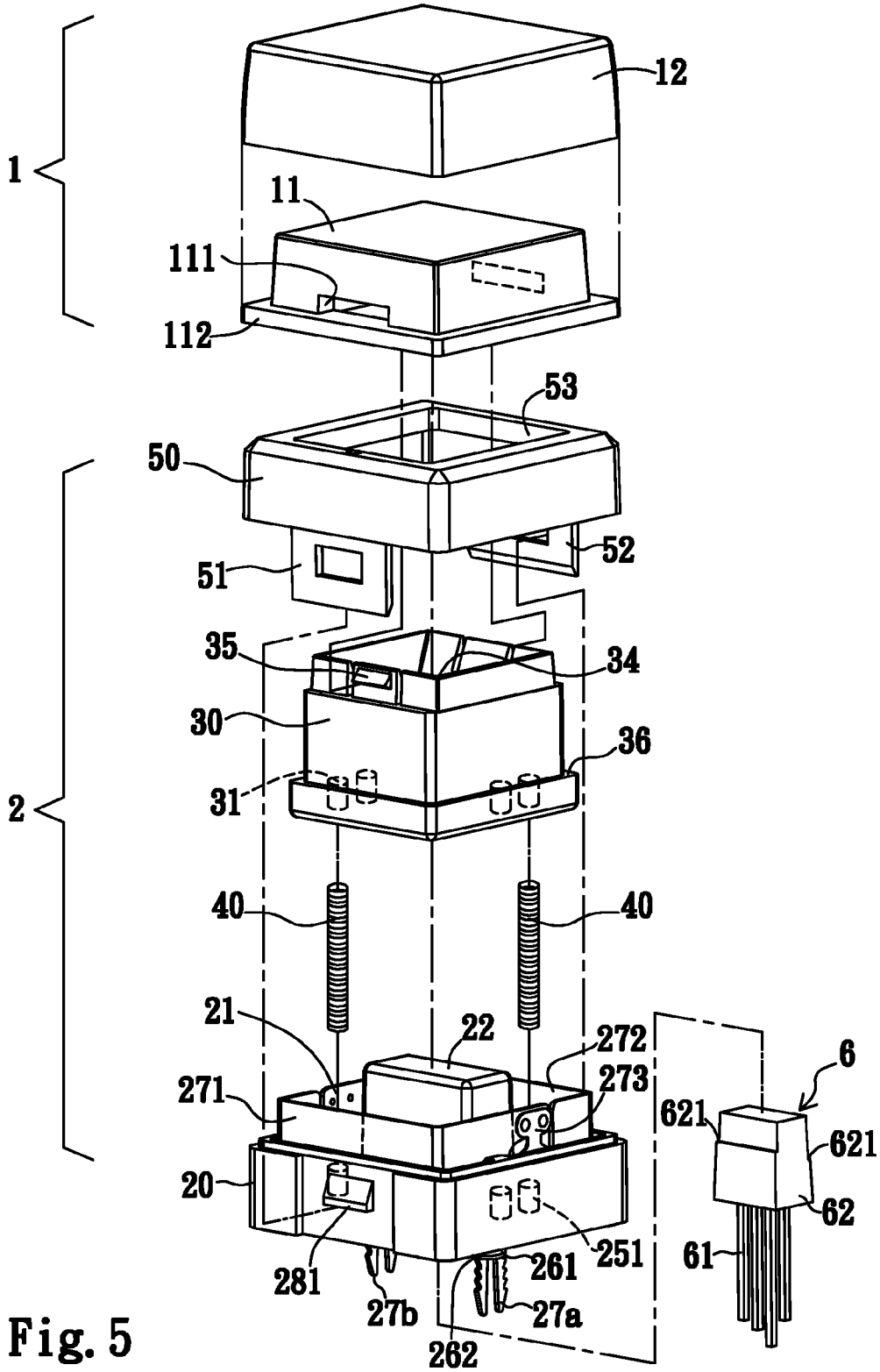
FIG. 5 is an exploded view of the FIG. 1.

As shown in FIGS. 2, 3 and 5, the structure of said illuminating push button switch is characterized in that having a base (20) incorporated a concave portion (21), a frame portion (30) disposed in said base (20), a hollow cover (50) where the hollow portion allows the frame portion (30) passes through, at least two vertical springs (40) and/or two horizontal springs (41) provided in the base (20) for supporting the frame portion (30), and at least two connector pins (27*a*, 27*b*) provided on a bottom side of the base (20). Said cap portion (1) is attached to a top of the frame portion (30). A light cap (22) is disposed inside said concave portion (21) and a slot (23) is provided on a bottom side for receiving at least one Epoxy case (62) of the LED (6). Said frame portion (30) has an axial passage (34) to allow the light cap (22) passes through from a bottom side thereof, and said frame portion (30) is allowed to move reciprocally along the light cap (22).

The passage (34) consists of a straight portion (341) for accommodating the light cap (22) at one end, and another end thereof connected to a tapered portion (342). Said tapered portion (342) is in a funneled shape and the angled side wall thereof guides the light evenly with a radiating fashion to illuminate the button side said cap portion (1).

The cap portion (1), as illustrated in FIGS. 3 and 5, includes an inner cap (11) having at least two slots (111), and an outer cap (12) covered said inner cap (11). The slots (111) correspond to two projections (35) provided on an upper portion of an outer wall of the frame portion (30), thus the cap portion (1) can attach to the frame portion (30) by engaging the slots (111) with the corresponding projections (35). The inner cap (11) doesn't need to be transparent; it can be manufactured with color which allows the penetration of light, thus even when the outer cap (12) is manufactured by an opaque material or with dark color, the illumination can still be observed from the shoulder (112).

Referring to FIGS. 2 and 5, said base (20) includes two wedge-shaped protrusions (281, 282) provided on two opposite sides of the outer wall. The wedge-shaped protrusions (281, 282) correspond two slots (51, 52) provided on two opposite sides of said cover (50). The protrusions (281, 282) and corresponding slots (51, 52) are manufactured into different sizes as a mistake-proof design. Since the LED (6) is attached to the base (20), the cathode and anode can be easily connected reversely to the printed circuit board (PCB) (9) and causing malfunction of the switch if the protrusions (281, 282) and slots (51, 52) are identical. By setting in different size, thus the base (20) and cover (50) can be coupled by only one direction which avoids the LED (6) being installed erroneously onto the PCB (9).

As for the frame portion (30), the cover (50) has an axial hole with corresponding size to allow the frame portion (30) passing through. A frame shoulder (36) is provided about the outer wall of the frame portion (30), and said shoulder (36) will contact with a projected edge (53) as to limit the reciprocal movement of the frame portion (30).

Figure 6:
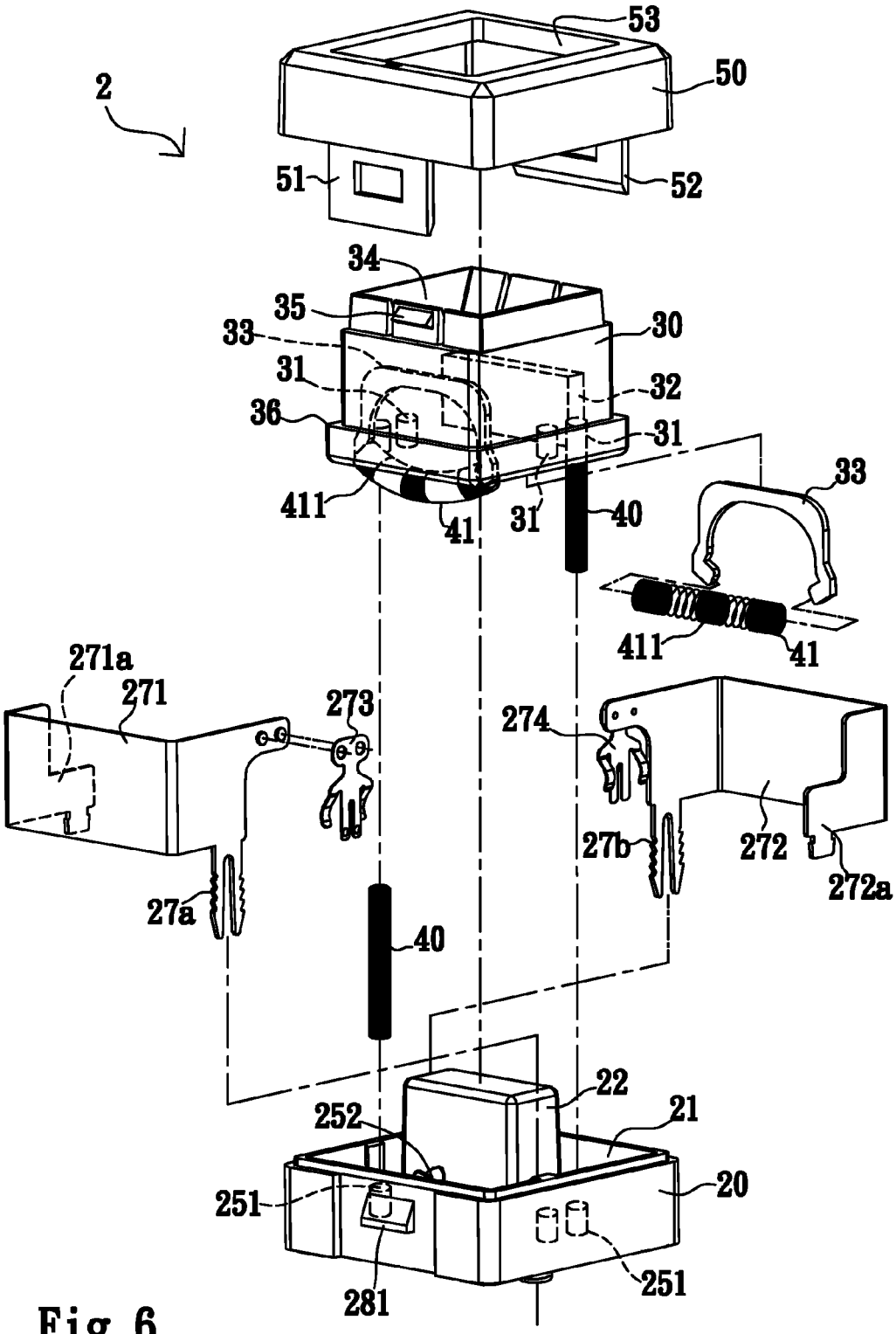
FIG. 6 is an exploded view of body portion of the present invention with horizontal springs incorporated.

For providing the reciprocal movement, vertical springs (40) or horizontal springs (41) are disposed between the frame portion (30) and concave portion (21). Referring to FIGS. 5 and 6, each of said compression spring (40) is provided in a vertical fashion wherein an end thereof each is engaged to a first column (251), provided at the concave portion (21) and another end is inserted into a positioning hole (31), provided at a bottom of the frame portion (30).

Each of said horizontal springs (41), as shown in FIGS. 3 and 6, is provided horizontally between two ends of a C-shaped holder (33). The holder (33) clamps the spring (41) causing it to form a curved shape. Said holder (33), with the extension spring (41) clamped between two ends, is provided at a groove (32) disposed at the bottom of said frame portion (30). The two ends and spring (41) are exposed from the groove (32). A second column (252) is provided at the concave portion (21) for supporting the exposed extension spring (41).

Referring to FIG. 6, said connector pin (27*a*) has a U-shaped metallic plate (271) at a top portion thereof, and said connector pin (27*b*) has a U-shaped metallic plate (272) at a top portion thereof. The plates (271, 272) are symmetrical and provided along an inner wall of said concave portion (21), and encircled about the periphery of said frame portion (30); when the frame portion (30) moves reciprocally, the movement is limited as the top of said plates (271, 272) butts the projected edge (53) disposed at an inner side of the cover (50); a first leaf-spring (273) is attached to a side of the plate (271) and a second leaf-spring (274) is attached to a side of the plate (272) for contacting an end (271*a*) of the plate (271) and an end (272*a*) of the plate (272) respectively to form a circuit.

Figure 4:
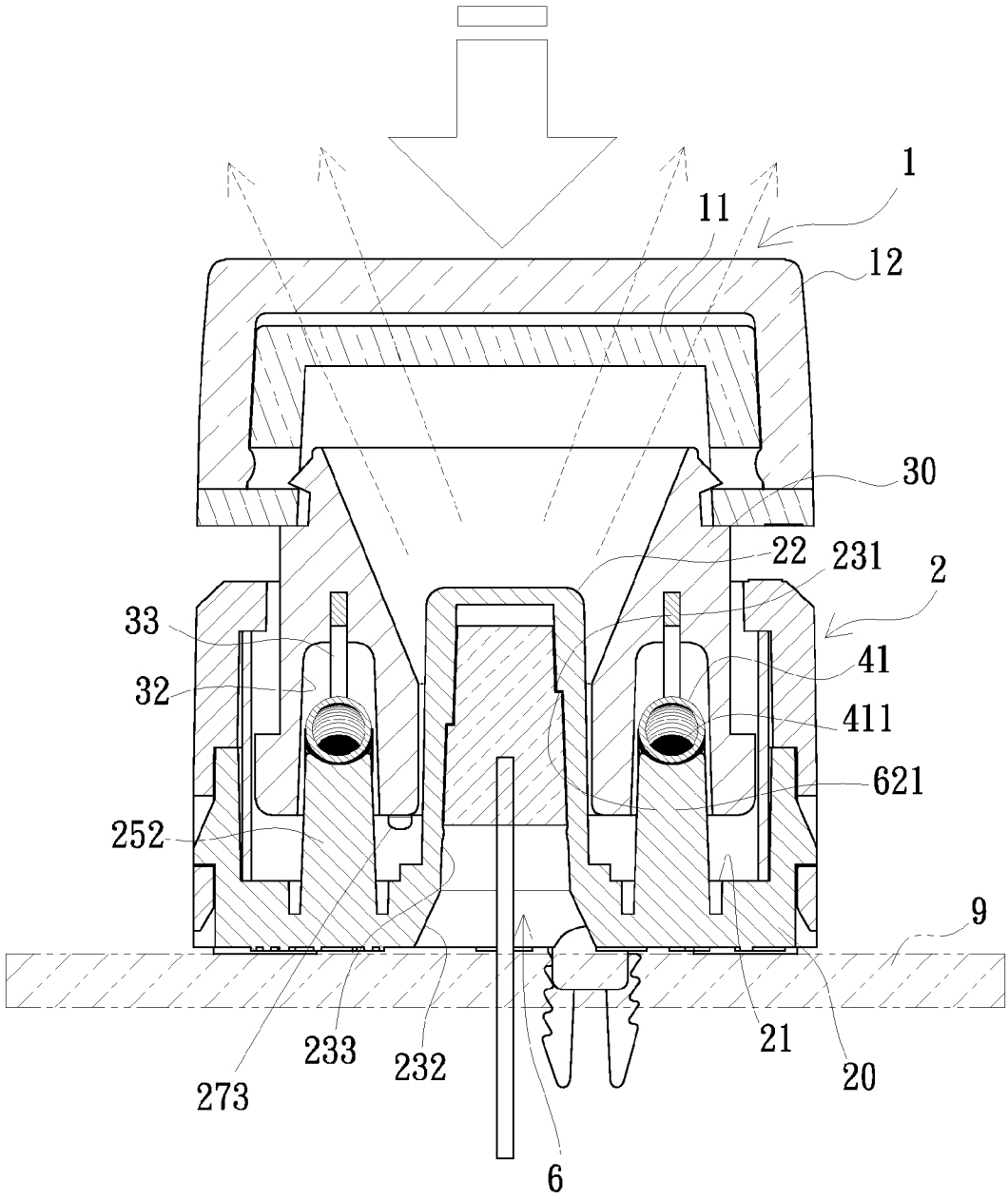
FIG. 4 is a schematic view of FIG. 3 illustrating the reciprocal movement of the frame portion of the present invention.

Referring to FIG. 4, the function of said illuminating push button switch is described hereinafter. When the cap portion (1) receives a force applied from the user, it drives the frame portion (30) attached hereunder and forces the vertical springs (40) between the base (20) and the frame portion (30) being compressed. The movement of the frame portion (30) is held until the curved horizontal springs (41) placed under are against the corresponding first columns (251) and pushed into the groove (32). The frame shoulder (36) pushes the first and second leaf springs (273, 274) outwardly and contacting the metal plates (271, 272) as disclosed previously to form the circuit and illuminate the LED (6). The light emitted from the LED (6) is guided and radiated through the tapered hole (342) for illuminating the cap portion (1). When the force is released, compressed springs (40, 41) restore to their normal states and push the frame portion (30) back to the original position hereof.

For switch having smaller size, which the horizontal springs (41) aren't able to be provided; plurality vertical springs (40) can be disposed only, as shown in FIG. 1, for providing reciprocal movement of the frame portion (30).

The conventional Epoxy case of a LED is usually in a bullet shape, even though the anode and cathode has different length, it still can be installed reversely for its rounded shape. Therefore, a mistake-proof design is added when manufactures the LED (6) to ensure the installation being properly and correctly. As shown in FIGS. 3 and 4, the Epoxy case (62) is made into a shape of a hexahedron, and a pair of jointing projections (621), disposed at two opposite ends and different height, are provided at an outer wall of the Epoxy case (62). Since the Epoxy case (62) will engage with the slot (23), a pair of locking projections (231), corresponding to the jointing projections (621), are provided at an inner wall of the slot (23). Thus, the LED (6) is installed and inserted properly when the jointing projections (621) meet corresponding locking projections. As for securing the position of Epoxy case (61) within the slot (23), at least two bulges (234) can be provided at the inner wall thereof, to prevent the LED (6) disengaged with the switch.

Said slot (23) consists of an opening (232) having an angled side wall and a compartment (233) for receiving the Epoxy case (62) of the LED (6). The angled opening (232) guides and introduces the LED (6) into the compartment (233), and said locking projections (231) are provided on the side wall of the compartment (233) to secure the position thereof. Two convex portion or bulges (234) are also disposed at where the opening (232) connecting with the compartment (233) as a further design to avoid disengagement of the LED (6).

Figure 7:
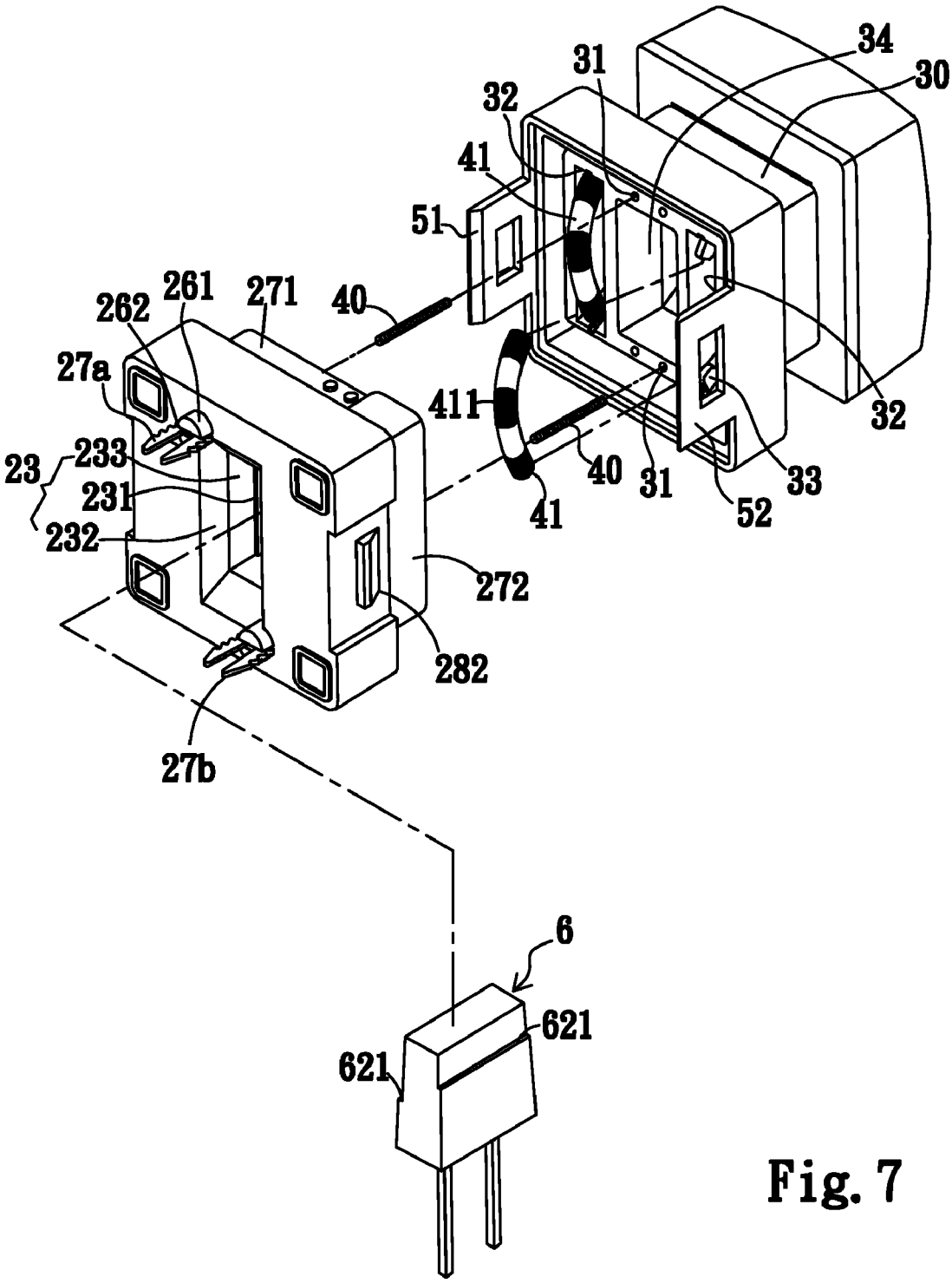
FIG. 7 is a disassembled view of the FIG. 1, separating the base and the LED from the switch.

The bottom side of the base (20) is illustrated in FIG. 7. Two cylindrical holders (261) are provided at the bottom thereof. Each holder (261) has a horizontal slit (262) to allow said connector pins (27*a*, 27*b*) to pass and secured by the holder (261).

Figure 8:
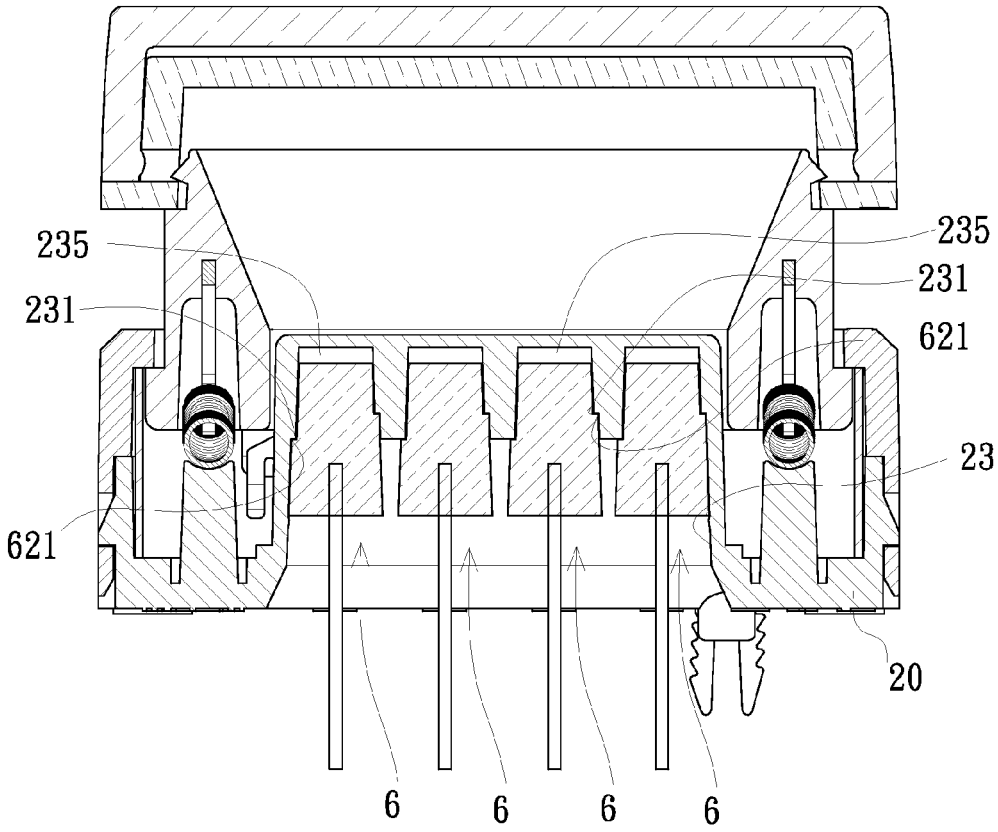
FIG. 8 is a cross sectional view of another embodiment of the present invention.
Figure 9:
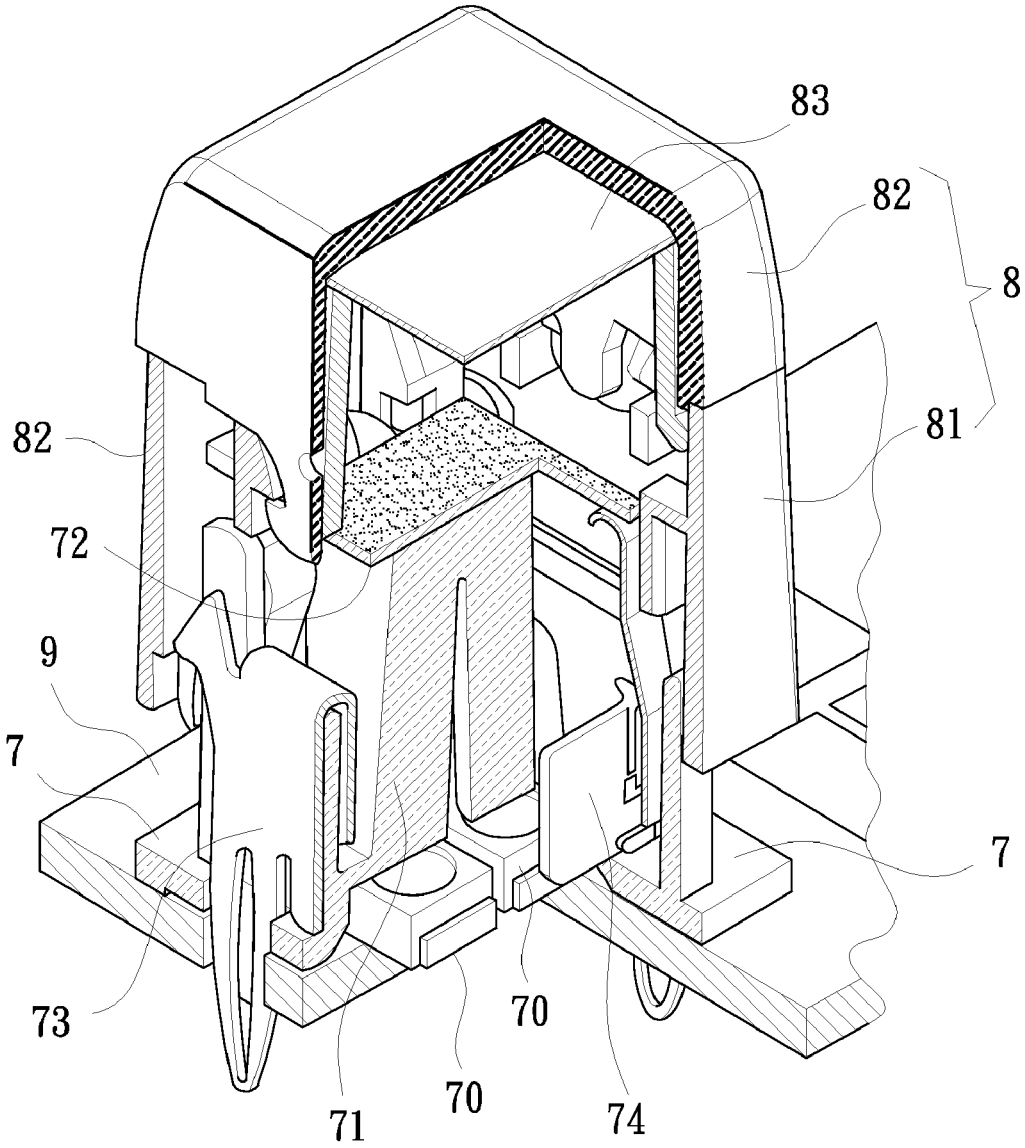
FIG. 9 is a cut-away view of a conventional push button switch.

FIG. 8 discloses an alternative embodiment of the present invention. In this embodiment, a plurality of LED (6) are accommodating inside the slot (23). For receiving multiple LEDs (6), multiples sub-compartments (235) having locking portions (231) are incorporated. The structure and function of each sub-compartment (235) are identical with the one described previously which will not be explained here.

The invention claimed is:

1. An illuminating push button switch comprises of a body portion (2) and a cap portion (1); an light emitting diode (LED) (6) is inserted therein for providing illumination; the switch button is characterized in that:

Said body portion (2) consists essentially of a base (20) incorporated a concave portion (21), a frame portion (30) disposed in said base (20), a hollow cover (50) which allows the frame portion (30) passes through, at least two vertical springs (40) and/or two horizontal springs (41) provided in the base (20) for supporting the frame portion (30), and at least two connector pins (27*a*, 27*b*) provided on a bottom side of the base (20); said cap portion (1) is attached to a top of the frame portion (30); a light cap (22) is disposed inside said concave portion (21) and a slot (23) is provided on a bottom side for receiving at least one Epoxy case (62) of a LED (6); said frame portion (30) has an axial passage (34) to allow the light cap (22) passes through from a bottom side thereof, and said frame portion (30) is allowed to move reciprocally along the light cap (22).

2. The illuminating push button switch of claim 1, wherein a top portion of said connector pin (27*a*) is a U-shaped metallic plate (271), and a top portion of said connector pin (27*b*) is a U-shaped metallic plate (272); both plates (271, 272) are symmetrical and provided along an inner wall of said concave portion (21), and encircle about a periphery of said frame portion (30); a top of said plates (271, 272) contacts with a projected edge (53) disposed at an inner side of the cover (50); a first leaf-spring (273) is extended from an end of the plate (271) and a second leaf-spring (274) is extended from an end of the plate (272); said leaf-springs (273, 274) are pushed outwardly by said frame portion (30) for contacting with pressing an end (272*a*) of the plate (272) and an end (271*a*) of the plate (271) respectively to form a closed circuit.

3. The illuminating push button switch of claim 1, wherein said passage (34) comprises of a straight portion (341) for accommodating the light cap (22) at one end, and another end thereof connected to a tapered portion (342); an angled side wall of the tapered portion (342) guides the light emission evenly with a radiating fashion to illuminate said cap portion (1).

4. The illuminating push button switch of claim 1, wherein two wedge-shaped protrusions (281, 282) are provided on two opposite sides of an outer wall of the base (20) to engage with two slots (51, 52) provided on two opposite sides of said cover (50).

5. The illuminating push button switch of claim 1, wherein said cap portion (1) comprises of an inner cap (11) having at least two slots (111), and an outer cap (12) covered said inner cap (11); said slots (111) correspond to two projections (35) provided on an upper portion of an outer wall of the frame portion (30).

6. The illuminating push button switch of claim 1, wherein an end of each said compression spring (40) is engaged to a first column (251), provided at the concave portion (21) and another end is inserted into a positioning hole (31), provided at a bottom of the frame portion (30).

7. The illuminating push button switch of claim 1, wherein each of said horizontal springs (41) is provided between two ends of a C-shaped holder (33), forming a curved shape; said holder (33) is provided at a groove (32) disposed at the bottom of said frame portion (30); a second column (252) is provided at the concave portion (21) for supporting the extension spring (41).

8. The illuminating push button switch of claim 1, wherein said LED (6) is attached to the switch by inserting an Epoxy case (62) into the slot (23).

9. The illuminating push button switch of claim 1, wherein a mistake-proof design is provided to prevent failure from the engagement of said Epoxy case (62) of the LED (6) with the slot (23); said design is characterized in that: a pair of locking projections (231), disposed at two opposite ends and different height of an inner wall of the slot (23), and a pair of jointing projections (621), corresponding to said locking projections (231), are provided at an outer wall of the Epoxy case (62).

10. The mistake-proof design of claim 9, wherein at least two bulges (234) are provided at the inner wall of said slot (23).

* * * * *